US006351618B1

(12) United States Patent
Pollocks, Jr.

(10) Patent No.: US 6,351,618 B1
(45) Date of Patent: Feb. 26, 2002

(54) METHOD OF USING A SECURITY SYSTEM FOR REPLACEABLE CARTRIDGES FOR PRINTING MACHINES

(75) Inventor: Lonnie J. Pollocks, Jr., Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/745,171

(22) Filed: Dec. 20, 2000

(51) Int. Cl.[7] ..... G03G 15/00
(52) U.S. Cl. ..... 399/12
(58) Field of Search ..... 399/12, 13

(56) References Cited

U.S. PATENT DOCUMENTS

| | | | | |
|---|---|---|---|---|
| 4,585,327 A | | 4/1986 | Suzuki | 355/3 R |
| 4,751,484 A | | 6/1988 | Matsumoto et al. | 355/14 |
| 4,961,088 A | | 10/1990 | Gilliland et al. | 355/206 |
| 5,016,171 A | | 5/1991 | Connolly et al. | 364/406 |
| 5,132,729 A | * | 7/1992 | Matsushita et al. | 399/12 X |
| 5,272,503 A | | 12/1993 | LSueur et al. | 355/208 |
| 5,486,899 A | * | 1/1996 | Iimori et al. | 399/24 |
| 5,579,088 A | * | 11/1996 | Ko | 399/12 |
| RE35,751 E | | 3/1998 | Midgley | 399/25 |

* cited by examiner

*Primary Examiner*—Fred L. Braun

(57) ABSTRACT

A method for using a security system for replaceable components of a electrostatographic reproducing machine which includes the steps of (1) providing the replaceable component with a memory source having a plurality of addressed floating memory locations; (2) randomly selecting one of the floating memory locations as a security location; and (3) writing a security code in the security location. The security code and the address of the security location in the machine memory device is stored in the machine's memory. Periodically, the code in the floating memory location at the address stored in the machine memory device is compared with the security code in the machine memory device. If the two codes are not the same, then an alert code is written into each of the addressed memory locations. If the two codes are the same, then the machine is placed in a stand by mode ready to make prints.

10 Claims, 6 Drawing Sheets

METHOD OF USING A SECURITY SYSTEM FOR REPLACEABLE CARTRIDGES FOR PRINTING MACHINES

FIELD OF THE INVENTION

The present invention relates to a printing and reproducing machine, and more particularly, to a security system for ensuring that cartridges are being used within their effective lifespan and according to any existing warranty or license.

BACKGROUND OF THE INVENTION

Printing and reproducing machines, such as electrostatographic and inkjet printers and copiers, commonly employ one or more replaceable sub-assemblies or units, generally referred to as cartridges or CRU's (Customer Replaceable Units). A common replaceable cartridge, or CRU, is the photoreceptor cartridge containing the photoreceptor and necessary supporting hardware in a single unit designed for insertion and removal into and out of the machine. When a cartridge is expended, the old cartridge is removed and a new cartridge is installed. Other frequently used replaceable cartridges include developer cartridges, toner cartridges, ink cartridges or tanks, and developer replenisher bottles.

U.S. Pat. No. 4,585,327 (Suzuki) discloses a copier employing a removable magazine containing a photosensitive belt. A counter in the machine's controller counts the number of copies made with the magazine, and generates a signal that warns the user that the service life of the photosensitive belt has come to an end when the count reaches a preset number of copies. The counter in the machine's controller is automatically reset upon insertion of a new magazine into the machine. To prevent inadvertent reuse of a spent magazine, a part of the magazine that resets the machine's counter is broken off when the magazine is first loaded into the machine. Thus, resetting of the counter upon reinsertion of a previously used magazine is prevented. An image forming machine that records the usage of a photosensitive drum, and stops the drum and renders the machine inoperable after a preset number of copies is disclosed in U.S. Pat. No. 4,751,484 issued to Matsumoto et al.

It is desirable to provide a means by which only the appropriate type of cartridge and only appropriately manufactured cartridges may be used with a specific electrostatographic reproducing machine. If an incorrect or improperly manufactured cartridge is inserted into the machine, it may have a detrimental affect on the quality and/or quantity of the documents produced by the machine. Furthermore, an improperly or poorly designed cartridge may detrimentally affect components of the electrostatographic reproducing machine, and may therefore void any warranty on the machine. It is also important to ensure that CRU's are not used beyond the useful life of the CRU. Using a CRU beyond its useful life may likewise have a detrimental effect on print quality and/or on machine components, possibly voiding any warranty. In some instances, it is desirable to determine whether a machine being operated under a contract or license is being used in accordance with the license.

In order to automatically determine whether a replaceable cartridge or CRU is the correct type of CRU upon insertion of the CRU into the machine, it is known to provided the CRU with a monitoring device commonly referred to as a CRUM (Customer Replaceable Unit Monitor). A CRUM is typically a memory device, such as a ROM, EEPROM, SRAM, or other suitable non-volatile memory device, provided in or on the cartridge. Information identifying the CRU is written on the EEPROM during manufacture of the CRUM. For example, information identifying a CRU as a developer cartridge and identifying the type of carrier, developer, and transfer mechanism contained in the developer cartridge may be written in the memory contained in the CRUM. When a CRU containing such a CRUM is installed in a machine, the machine's control unit reads the identifying information stored in the CRUM. If the CRU is the wrong type of unit for the machine, then a "Wrong Type of Cartridge" message is displayed on the machine's control panel and the machine is deactivated preventing use of the incorrect cartridge. Such a "security CRUM" system is disclose in U.S. Pat. No. 4,961,088 issued to Gilliland et al.

The maximum number of prints that a CRU is designed, licensed or warranted to produce is also commonly programmed into the CRUM during manufacture of the CRU. When a given cartridge has reached its maximum number of prints, the machine is disabled and a "Change Cartridge" message is displayed on the control panel. The spent CRU must be removed and a new CRU must be installed in order to reactivate the machine and continue making prints. Prior to removal of the spent CRU, the machine's control unit writes data indicating that the CRU has been exhausted into the CRUM's memory. Should a spent cartridge be reinserted into the machine, the control unit will identify the CRU as a spent CRU upon reading the CRUM. Upon identifying a newly installed CRU as a spent CRU, the control unit disables the machine and displays a "Change Cartridge" message on the display panel. Thus, inadvertent reuse of an exhausted CRU is prevented. When remanufacturing a used CRU, the CRUM must be reset or replaced with a new CRUM, before the remanufactured CRU may be used in a electrostatographic machine without being identified as an exhausted cartridge.

In order to prevent resetting and reuse of spent CRU's beyond their effective lifespan, or beyond the term of a warranty or license, it is known to provide a "kill zone" in the memory of a CRUM attached to the CRU. The known kill zones are a fixed area in the CRUM's memory that, when an attempt to read or access this portion of the memory is made, disables all functionality of the CRUM and causes the machine to stop functioning. For example, one or more of the useful datapoints in the CRUM, such as the datapoint in the CRUM identifying the number of images remaining in the useful life of the cartridge, may be set to zero when an attempt to read or access the kill zone is made. Setting such a useful datapoint to zero will cause the machine to cease operating and display a "Replace Cartridge" message on the display panel. In this way a consumer is prevented from employing a CRU that has been improperly remanufactured beyond its useful or warranted life, and the possible detrimental consequences in the form of reduced print quality, possible damage to machine components, and loss of warranty are prevented.

In some instances, consumers have been successful in identifying the location of the fixed kill zone in the previously discussed "security CRUM's." After identifying the location of the fixed kill zone, it is possible to access the non-kill zone portions of the CRUM and reverse engineer the CRUM's architecture, programming, and identifying information and codes. Upon knowing the approved CRUM's architecture and identifying information and codes, it is possible to reprogram a spent CRU's CRUM, and continue to use the spent CRU. When extending the life of a CRU in this manner, a consumer may continue to use a degraded CRU with detrimental effects on the overall operation of the machine in terms of print quality or quantity, possibly voiding any warranties and damaging machine components in the process. In other cases, the consumer may be resetting the CRUM in order to continue operating the machine beyond the terms of a license or contract based on usage or time.

Reissued U.S. Pat. No. Re. 35,751, reissued on Mar. 24, 1998, discloses a monitoring system for replaceable units, such as toner cartridges in an electrophotographic printer, includes on the unit an electronic count memory and an electronic flag memory. The count memory maintains a one-by-one count of prints made with the cartridge. The flag memory includes a series of bits which are alterable from a first state to a second state but not alterable from the second state to the first state. The bits in the flag memory are altered at predetermined intervals as prints are made with the cartridge. The flag memory is used as a check to override unauthorized manipulation of the count memory.

U.S. Pat. No. 5,016,171 discloses a customer billing system for electrostatographic reproducing machines in which a replaceable copy cartridge provides a guaranteed number of copies or prints, each cartridge having an integral copy counter which, on reaching a predetermined copy count, is disabled, rendering the cartridge dead and activating an additional copy counting mechanism for counting a limited number of grace copies that can be made using the dead cartridge, after which further operation of the machine is prevented until a new cartridge is installed.

There is a need in the art for an improved method of preventing unauthorized access of the CRUM, in order to prevent reuse of a spent CRU beyond the effective life of the CRU, or beyond the term of a warranty or license.

SUMMARY OF THE INVENTION

The present invention provides a security method for a replaceable component of an electrostatographic reproducing machine. The method includes the following steps. Providing the replaceable component with a memory source having a plurality of addressed floating memory locations. Randomly selecting one of the floating memory locations as a security location. Writing a security code into the security location. Periodically repeating the steps of selecting a security location and writing a security number into the security location.

BRIEF DESCRIPTION OF THE DRAWINGS

The present invention will now be described, by way of example, with reference to the appended drawings, of which.

DETAILED DESCRIPTION OF AN EMBODIMENT OF THE INVENTION

According to one embodiment of the present invention, customer replaceable units (CRU's), in the form of replaceable cartridges, such as toner, developer and Photoreceptor cartridges, are provided with memory devices or CRUM's (Customer Replaceable Unit Monitors). Each CRUM contains data identifying the cartridge as the correct type of cartridge for use with the machine. Although the security system of the present invention is disclosed herein for use in electrostatographic laser printers, one of ordinary skill in the art will appreciate that the present invention is equally suited for use in a wide variety of processing systems, including electrostatographic and inkjet printers and copiers, and is not limited to use in the particular embodiment described herein.

Figure 1:
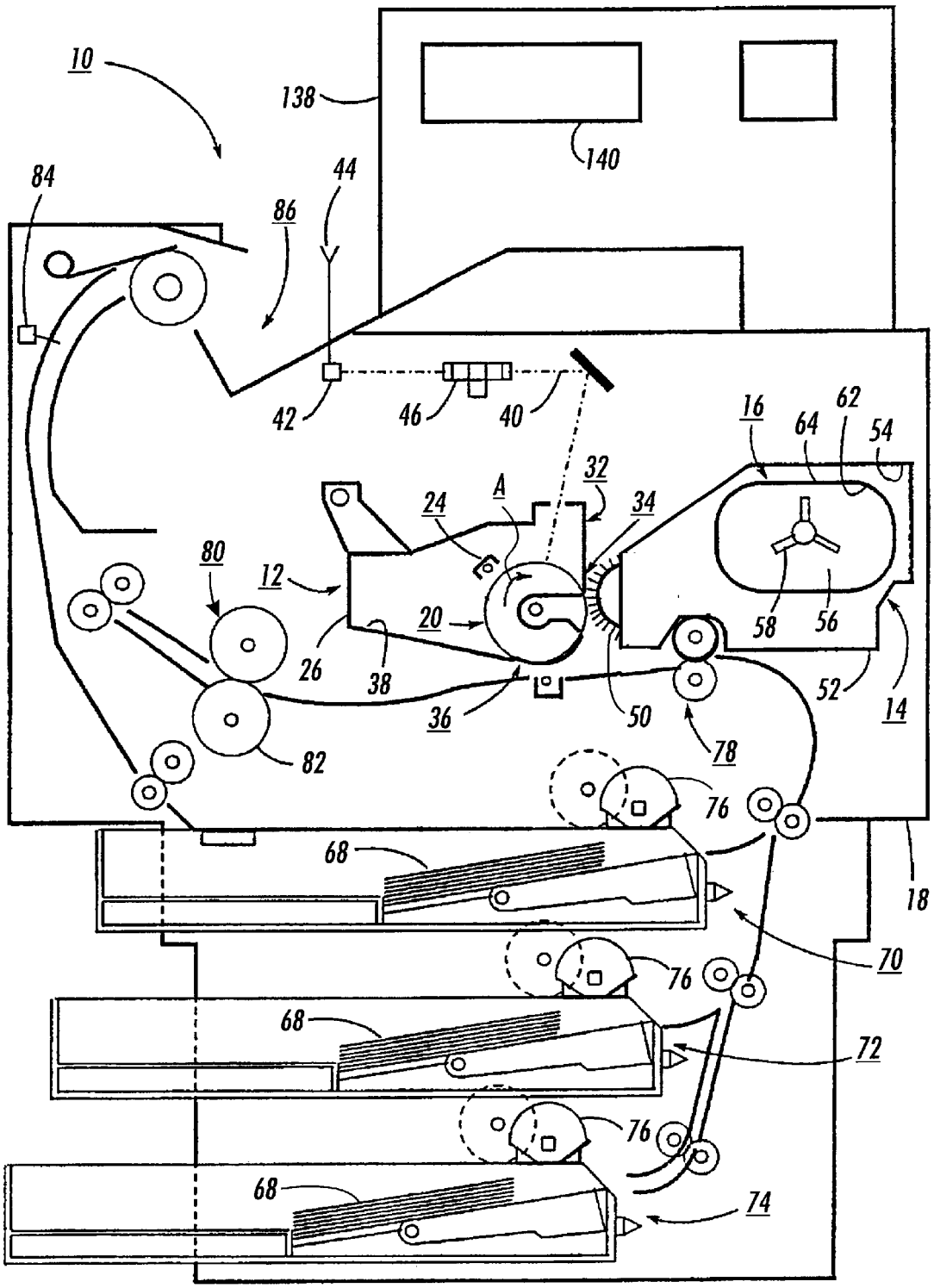
FIG. 1 is a schematic representation in cross section of an automatic electrostatographic reproducing machine having replaceable Photoreceptor, developer, and toner cartridges, each containing a security CRUM according to the teachings of the present invention.

Referring now to FIG. 1, there is shown by way of example an automatic electrostatographic reproducing machine 10 adapted to implement the CRUM security system of the present invention. In the example shown, reproducing machine 10 comprises a laser printer employing replaceable photoreceptor, developer, and toner cartridges or CRU's 12, 14, and 16 respectively. Each cartridge is designed and warranted, and perhaps licensed, to provide a preset maximum number of images X12, X14, and X16, respectively, in the form of prints or copies. The maximum number of images may be different for each cartridge. When the number of images produced by one of the cartridges reaches a predetermined quantity Y12, Y14, or Y16, which quantity is less than the maximum number of images X12, X14, and X16, a warning that the cartridge is nearing the end of its life is displayed on the machine's display panel. This warning allows the customer time to order a new cartridge, renew a license, call a service technician, or take any other required action. Following the warning, the machine will continue to make the remaining images. When the preset maximum number of images X12, X14, or X16 has been made with one of the cartridges, that cartridge is disabled, a "Replace Cartridge" message is displayed on the control panel, and further operation of the machine is prevented. At this point, the expended cartridge must be removed from the machine and a new cartridge installed in its place, before further operation of the machine is possible.

Figure 2:
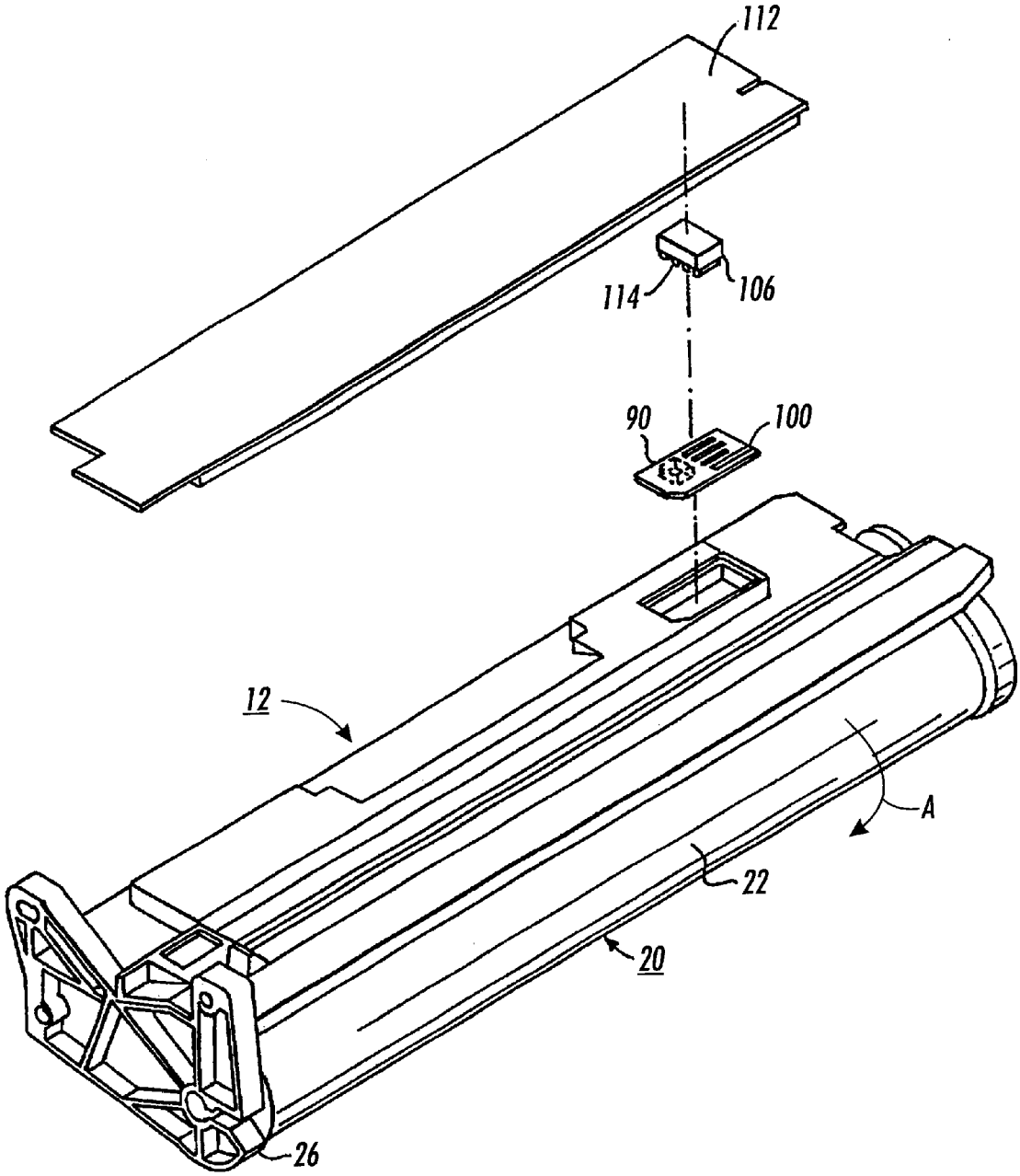
FIG. 2 is an isometric view of the replaceable Photoreceptor cartridge for the machine shown in FIG. 1, together with the mechanism for establishing electrical contact between the CRUM on the Photoreceptor cartridge and the machine control unit upon insertion of the cartridge into the machine.

Photoreceptor cartridge 12, illustrated in FIGS. 1 and 2, includes a photoreceptor drum 20, the outer surface 22 of which is coated with a suitable photoconductive material, and a charge corotron 24 (not shown in FIG. 2) for charging the photoconductive surface 22 in preparation for imaging. The drum 20 is rotationally mounted within a cartridge body 26. The drum rotates in the direction indicated by arrow A, in order to move the photoconductive surface consecutively through exposure 32, developer 34, and transfer 36 stations, as illustrated in FIG. 1. To receive the Photoreceptor cartridge 12, a suitable cavity 38 is provided in machine frame 18. The Photoreceptor cartridge body 26 and cavity 38 have complementary shapes and dimensions, such that upon insertion of the cartridge 12 into the cavity 38, the drum 20 is in a predetermined operating relation with the exposure 32, developer 34, and transfer 36 stations. Upon insertion of the cartridge 12 into the cavity 38, the drum 20 is drivingly coupled to the drum driving means (not shown) and the electrical connections to the cartridge 12 are made.

During the electrostatographic process, the photoconductive surface 22 of the drum 20 is initially uniformly charged by the charge corotron 24. The charged surface is then rotated to the exposure station 32, where the charged photoconductive surface 22 is exposed by an imaging beam 40 creating an electrostatic latent image on the photoconductive surface 22 of the drum 20. The imaging beam 40 is derived from a laser diode 42, or other suitable source, and is modulated in accordance with image signals from an image source 44. The image signal source 44 may comprise any suitable source of image signals, such as memory, document scanner, communication link, etc. The modulated imaging beam 40 output by the laser diode 42 is impinged on the facets of a rotating multi-faceted polygon 46, whereby the beam is swept across the photoconductive surface 22 of the drum 20 at the exposure station 32.

Figure 3:
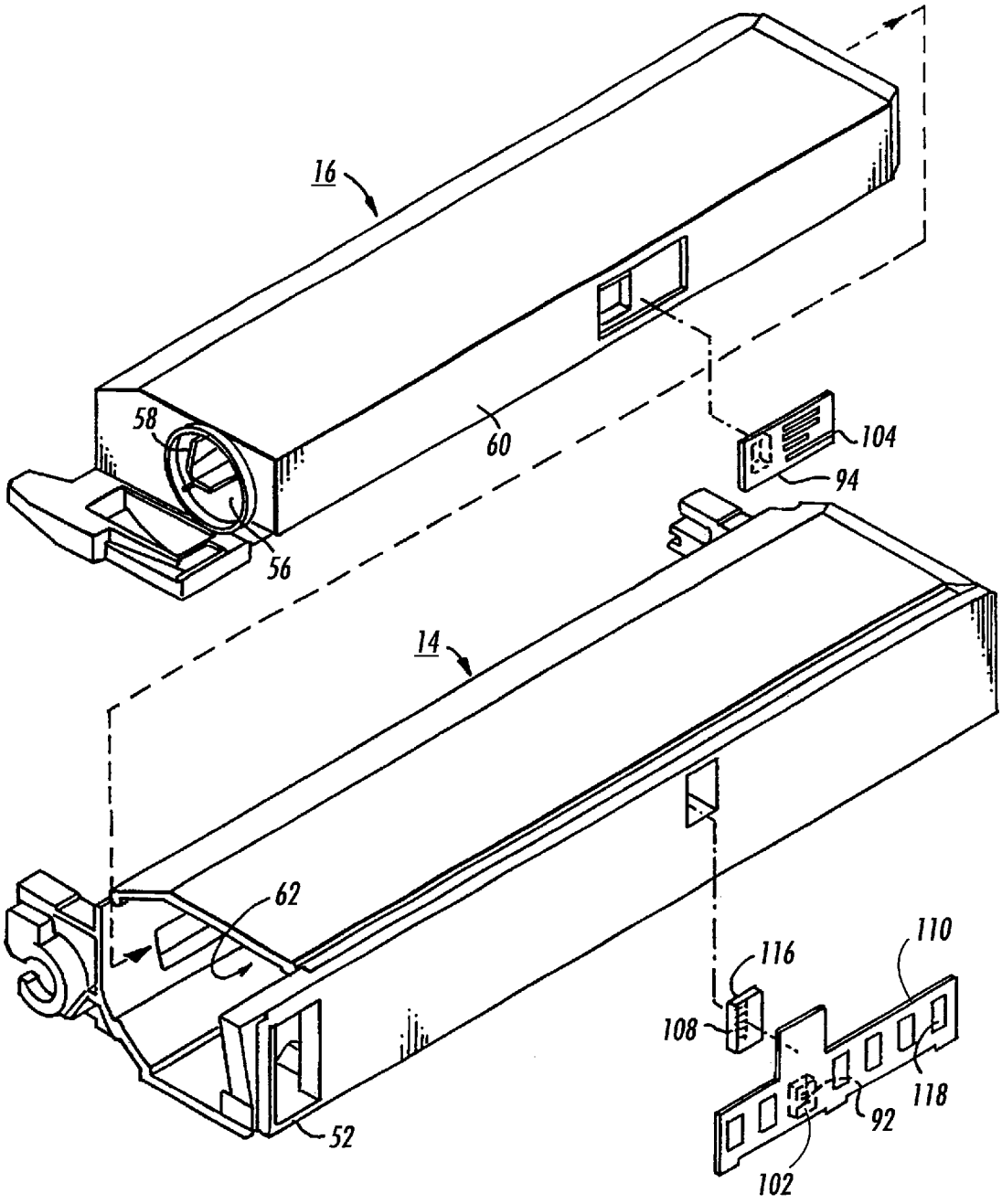
FIG. 3 is an isometric view of replaceable developer and toner cartridges for the machine shown in FIG. 1, together with the mechanism for establishing electrical contact between the CRUM'S on the developer and toner cartridges and the machine control unit upon insertion of the cartridges into the machine.

Following exposure, an electrostatic latent toner image is developed on the photoconductive surface 22 of the drum 20 at the developer station 34 by a magnetic brush development system contained in the developer cartridge 14, illustrated in FIGS. 1 and 3. The magnetic brush development system includes a suitable magnetic brush roll 50 (not shown in FIG. 3) rotatably mounted in body 52 of the developer cartridge 14. Developer is supplied to the magnetic brush roll 50 by the toner cartridge 16. To receive the developer cartridge 14, a suitable cavity 54 is provided in the machine frame 18. The developer cartridge body 52 and the cavity 54 have complementary shapes and dimensions, such that upon insertion of the developer cartridge into the cavity, the magnetic brush roll 50 is in a predetermined developing relation with the photoconductive surface 22 of the drum 20. Upon insertion of the developer cartridge 14, the magnetic brush roll 50 is drivingly coupled to a developer driving means (not shown) in the machine 10 and the electrical connections to the developer cartridge 14 are made.

The toner cartridge 16, illustrated in FIGS. 1 and 3, includes a sump 56 containing developer. The developer comprises a predetermined mixture of carrier and toner. A rotating auger 58 mixes the developer in the sump 56 and transfers developer to the magnetic brush roll 50. The auger 58 is rotatably mounted in the body 60 of the toner cartridge 16.

As seen best in FIG. 3, the body 52 of the developer cartridge 14 includes a cavity 62 formed therein for receipt of the toner cartridge 16. The cavity 62 in the developer cartridge 14 and the body 60 of toner cartridge 16 have complementary shapes and dimensions, such that upon insertion of the toner cartridge into the cavity, the toner cartridge 16 is in predetermined operating relation with the magnetic brush roll 50. Upon insertion of the toner cartridge 16 in the cavity 62, the auger 58 is drivingly coupled to the developer driving means (not shown) and the electrical connections to the toner cartridge are made.

With reference to FIG. 1, prints of the images formed on the photoconductive surface of the photoreceptor drum 20 are produced by the machine 10 on a suitable support material, such as copy sheet 68 or the like. A supply of copy sheets 68 is provided in a plurality of paper trays 70, 72, 74. Each paper tray 70, 72, 74 has a feed roll 76 for feeding individual sheets from stacks of sheets stored in the trays 70, 72, 74 to a registration pinch roll pair 78. The sheet is forwarded to the transfer station 36 in proper timed relation with the developed image on the photoreceptor drum 20. The developed image is transferred to the copy sheet 68 at the transfer station 36 in a known manner. Following transfer, the copy sheet bearing the toner image is separated from the photoconductive surface 22 of the photoreceptor drum 20 and advanced to a fixing station 80. At the fixing station, a roll fuser 82 fuses the transferred toner image to the copy sheet in a known manner. A suitable sheet sensor 84 senses each finished print sheet as the sheet passes from the fixing station 80 to an output tray 86. Any residual toner particles remaining on the photoconductive surface 22 of the photoreceptor drum 20 after transfer are removed by a suitable cleaning mechanism (not shown) contained in the Photoreceptor cartridge 12.

Referring again to FIGS. 2 and 3, each cartridge 12, 14 and 16 includes an identification and monitor chip or CRUM (Consumer Replaceable Unit Monitor) 90, 92 and 94. Each CRUM includes an Electrically Erasable Programmable Read Only Memory (EEPROM), or other suitable non-volatile memory device, for the storage of data. In order to ensure that only the correct type of Photoreceptor 12, developer 14, and toner 16 cartridges are used in the machine 10, a code that identifies the type of the cartridge is pre-programmed into each CRUM's memory during manufacture. Other useful data, such as the type of toner or developer in the cartridge, batch number, serial number, term of a warranty or paid for license, etc., may also be pre-programmed in a CRUM's memory during manufacture. In order to track the usage of each cartridge, a running count of the number of images made with each cartridge is maintained in each cartridge's CRUM 90, 92, 94 during operation of the machine 10. Contact pads 100, 102, 104 enable the CRUM's 90, 92 and 94 to be electrically connected and disconnected with corresponding contact pads or terminals on the machine 10 upon installation or removal of the cartridges. Terminal blocks 106, 108 and a terminal board 110 cooperate with the contact pads to complete the electrical connection between the CRUM'S 90, 92, 94 and the machine 10.

As seen in FIG. 2, the terminal block 106 for the photoreceptor cartridge 12 is mounted on a terminal board 112. The terminal board 112 is located in the cavity 38 in the machine frame 18 within which the photoreceptor cartridge fits. Upon installation of the Photoreceptor cartridge 12 into the cavity 38, the contact pads 100 on the Photoreceptor cartridge's CRUM 90 engage contacts 114 of the terminal block 106, thereby forming the electrical connection between the CRUM 90 and the machine.

As seen in FIG. 3, the terminal block 108 for the toner cartridge 16 is mounted on the terminal board 110, which is attached to the developer cartridge housing 52. The CRUM 92 for the developer cartridge 14 is also mounted on the terminal board 110. Upon installation of the toner cartridge 16 into the cavity 62 in the developer cartridge housing, the contact pads 104 of the toner cartridge CRUM 94 engage contacts 116 of the terminal block 108 on the terminal board 110. Upon installation of the developer cartridge 14 into the cavity 54 in the machine frame 18, contact pads 118 on the terminal board 110 engage contact pads (not shown) located in the cavity 54 in the machine. The CRUM 92 of the developer cartridge and the CRUM 94 of the toner cartridge 16 are thereby electrically connected to the machine via contact pads 118 on the terminal board 110.

Figure 4:
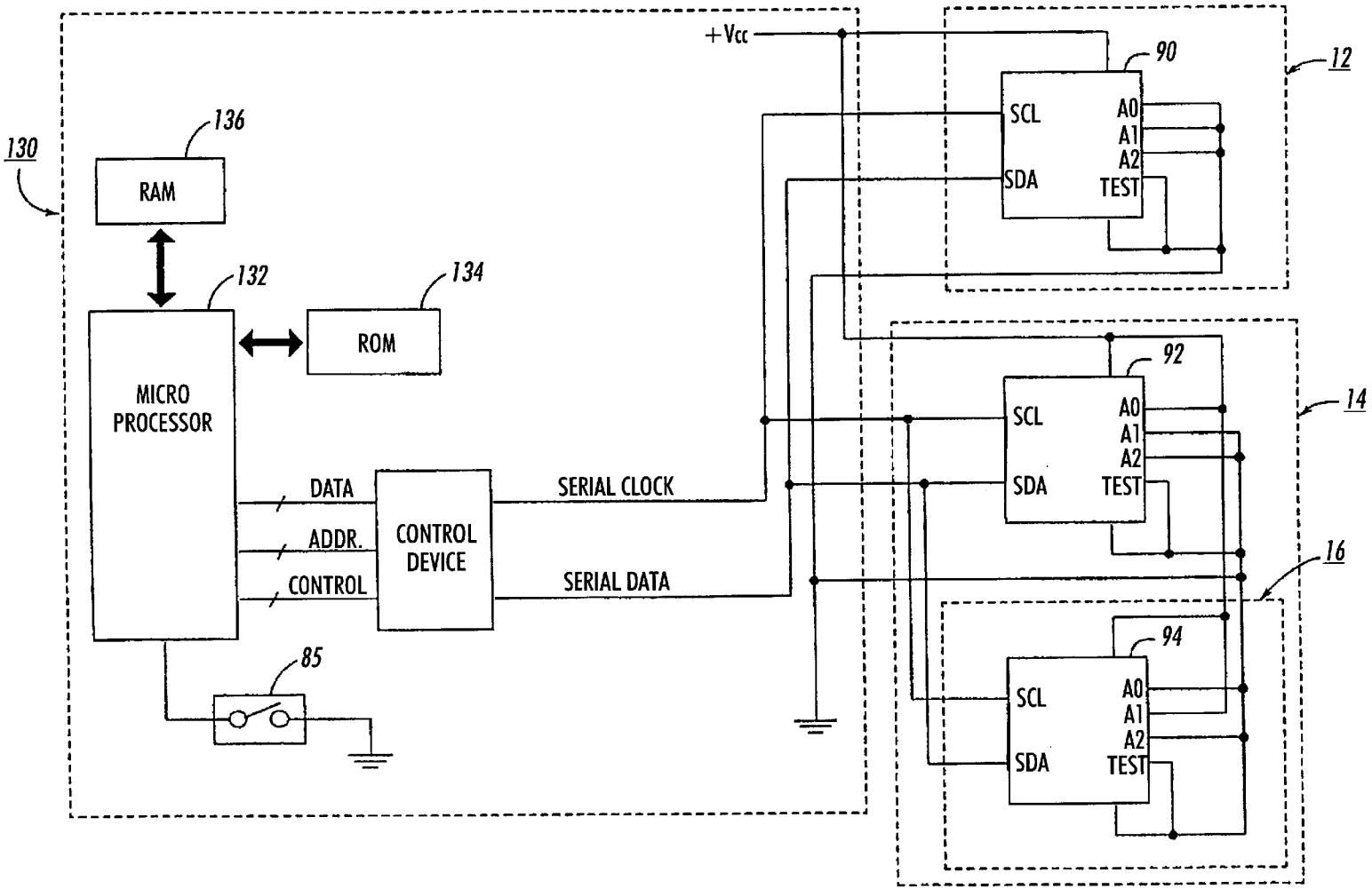
FIG. 4 is a schematic showing the machine control unit and its coupling with the CRUM'S of the Photoreceptor, developer and toner cartridges.

As previously mentioned, the CRUM's 90, 92 and 94 contain addressable memory (EEPROM'S) for storing or logging a count of the number of images remaining on each cartridge 12, 14 and 16. The current number of images produced by each cartridge, or current image count Y12, Y14 and Y16, is stored on the various EEPROM's by the machine control unit (MCU) 130 (see FIG. 4) at the end of each print run. Each cartridge's CRUM is initially pre-programmed during manufacture with a maximum count X12, X14 and X16, respectively, reflecting the maximum number of images that can be produced by the corresponding cartridge. Alternatively, the CRUM may be programmed with maximum count reflecting a licensed quantity of prints or images.

The counting system may be an incrementing or a decrementing type system. In an incrementing system, the current image count Y12, Y14 and Y16 in the CRUM's 90, 92 and 94, which is initially set to zero, are incremented as images are produced. When the current image count Y12, Y14 and Y16 reaches the maximum count X12, X14 and X16, the cartridge is rendered unusable. To alert or warn the customer when a cartridge is nearing the end of its useful licensed life, a warning count W12, W14 and W16, that is somewhat less than the maximum count, is also pre-programmed into the CRUM's 90, 92 and 94. When the warning count is reached, a message is displayed in the display window 140 of the control panel 138 that warns the operator that the cartridge (or license) is nearing the end of its effective life and should be replaced soon. Typically, the warning count W12, W14 and W16 provides a few hundred to a few thousand images, depending on the type of machine involved, within which the operator must install a replacement cartridge, or renew a license by purchasing a new cartridge or calling a service technician, in order to ensure continued operation of the machine.

A suitable machine control unit (MCU) 130 (diagrammatically illustrated in FIG. 4) is provided for controlling operation of the various component parts of the machine 10 in an integrated fashion to produce prints. MCU 130 includes one or more microprocessors 132 and suitable memory, such as ROM 134 and RAM 136, for holding the machine operating system software, programming, data, etc. A control panel 138 (see FIG. 1) with various control and print job programming elements is also provided. Panel 138 additionally includes a message display window 140, for displaying various operating information to the machine operator.

Whenever the machine 10 is powered up, an initialization and security routine is performed by the MCU 130. During the initialization and security routine, the identification numbers of the cartridges 12, 14, and 16 are read from each cartridge's CRUM and compared with corresponding recognition numbers stored in the ROM 134 of the MCU 130. If the identification number of one of the cartridges does not match the recognition number for that cartridge, then the effected cartridge is disabled preventing operation of the machine 10 until a correct cartridge is installed. The effected cartridge may be disabled by setting a useful datapoint in the CRUM to a disabling value. For example, the current image count Y may be set to a value equal to or greater than the maximum image count X. Following which, the message 'Wrong Type Cartridge' is displayed in the display window 140.

When it is determined that the correct cartridges are installed, a check is made to see if any of the cartridges 12, 14, or 16 have reached the end of their useful, warranted or licensed life. The current image count Y12, Y14 and Y16 logged in each cartridge's CRUM is obtained and compared with the maximum number of images X12, X14 and X16. When the current image count on a cartridge is equal to or greater than the maximum number of images warranted or licensed for that cartridge, the message "End of Life" is displayed for the exhausted cartridge in the display window 140. Operation of the machine 10 is inhibited until the exhausted cartridge is replaced. When it is determined that none of the cartridges 12, 14, nor 16 have reached an end of life condition (and no other faults are found), the machine enters a standby state ready to make prints.

Upon a print request, the machine 10 cycles up and commences to make prints. The control unit 130 counts each time a finished print is detected by the print sensor 84 as the finished print passes from the fixing station 80 into the output tray 86. When the print run is completed and the machine cycles down, the total number of images made during the run, i.e., the image run count, is temporarily stored in RAM 136. The control unit retrieves the current image count Y12, Y14 and Y16 from the EEPROM 90, 92, 94 of each cartridge 12, 14, 16 and, using the image run count from the RAM, calculates a new current image count Y12, Y14 and Y16 for each cartridge's EEPROM. The control unit then writes the new current image count into the individual EEPROM's 90, 92 and 94 of each cartridge's CRUM.

Prior to recording the new current image counts Y12, Y14 and Y16 in CRUM's 90, 92 and 94, the control unit 130 compares each new current image count Y12, Y14 and Y16 against the warning count W12, W14 and W16 stored in EEPROM's 90 of each cartridge's 12, 14, 16 CRUM. Where the current image count is equal to or greater than the warning count, a message "Order Replacement Cartridge" is displayed for the particular cartridge in the display window. This alerts the operator to the fact that the identified cartridge is about to expire and a new replacement cartridge should be obtained, if one is not already on hand. The new current image count Y12, Y14 and Y16 for each cartridge is also compared with the maximum number of images X12, X14 and X16. When the current image count is equal to or greater than the maximum number of images for any one of the cartridges 12 14 or 16, that cartridge is disabled and the message "End of Life" is displayed for that cartridge in the display window 140. Control unit 130 prevents further operation of the machine 10 until the expired cartridge is replaced with a new approved cartridge.

It will be understood that, since the current image count Y12, Y14 and Y16 is updated and compared with the maximum number of images X12, X14 and X16 when machine 10 is cycled down at the end of an image run, it is possible for the current image count on a cartridge to exceed the maximum number of images X12, X14 and X16. This occurs when the current image count on a cartridge is close to zero at the start of a job run and the number of prints programmed for the job is greater than the number of images remaining on the cartridge. Rather than interrupt the job in midstream, cartridges 12, 14, and 16 are designed with a safety factor enabling a predetermined number of additional images over and above the maximum image count to be made.

Figure 5:
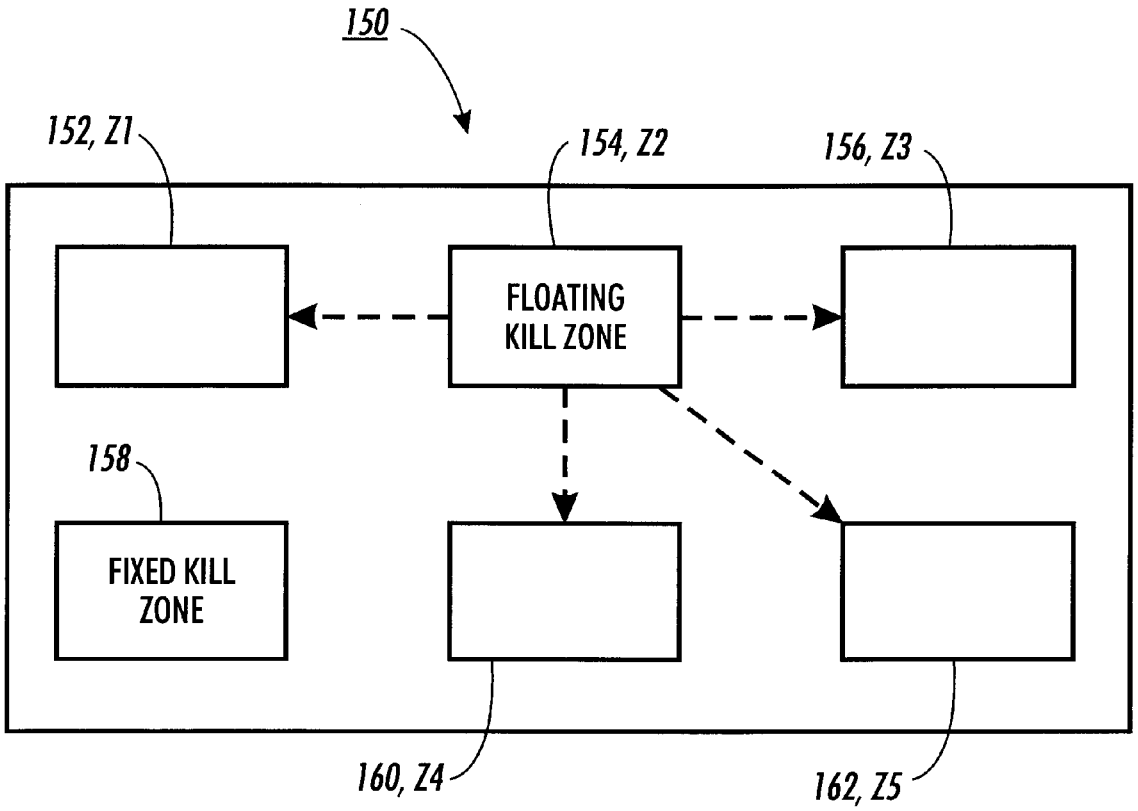
FIG. 5 is a diagrammatic illustration of a CRUM EEPROM containing a floating dynamic kill zone according to the present invention.

FIG. 5 diagrammatically illustrates an EEPROM containing a floating kill zone according to the present invention. The illustrated EEPROM 150 contains six non-volatile memory locations 152, 154, 156, 158, 160 and 162. One of the memory locations 158 is illustrated as containing a fixed kill zone. The five remaining memory locations 152, 154, 156, 160 and 162 are reserved for the floating kill zone, and have been designated in FIG. 5 as available kill zone locations Z1, Z2, Z3, Z4, and Z5. It will be appreciated that a floating kill zone according to the present invention may be used without a fixed kill zone. It will also be appreciated that the EEPROM may have any number of available kill zone locations, Z1 through Zn, other than the illustrated five locations Z1–Z5.

When a fresh CRU having zero prints registered in the CRUM is installed in the machine 10. The machine control unit, MCU 130 (see FIG. 4), randomly selects one of the kill zone locations Z1–Z5 as a current kill zone location and randomly generates a random number, for example a five digit number, as a current security number. The controller then writes the generated current kill zone location and current security number into the MCU's ROM, and writes the current security number in the current kill zone location in the CRUM's EEPROM 150. The MCU periodically selects a random new current kill zone location and a random new current security number. The MCU then updates the current kill zone location and the current security number in the MCU's ROM, and writes the new current security number into the new current kill zone location in the CRUM's EEPROM. The MCU periodically reads the current security number and the current kill zone location from the ROM. The MCU then compares the current security number stored in the ROM, with the security number stored in the current kill zone location in the CRUM, in order to determine if the CRUM has been tampered with.

If the security number in the current kill zone in the CRUM does not match the current security number stored in the MCU, then an encrypted alert messaged is written into each kill zone location Z1–Z5. The encrypted message is subsequently read by a service technician, who may then report the occurrence to the manufacturer or supplier. The CRU may be programmed to allow the machine to continue operating. Continued operation will, however, be without guaranteed accuracy of continued print counts and without guaranteed accurate reorder and end of life messages for the effected CRU. As a result, continued operation of the machine at optimum performance can no longer be guaranteed. Alternatively, the CRU may be programmed to disable the effected CRU, and prevent further operation of the machine until a new CRU is installed.

Figure 6:
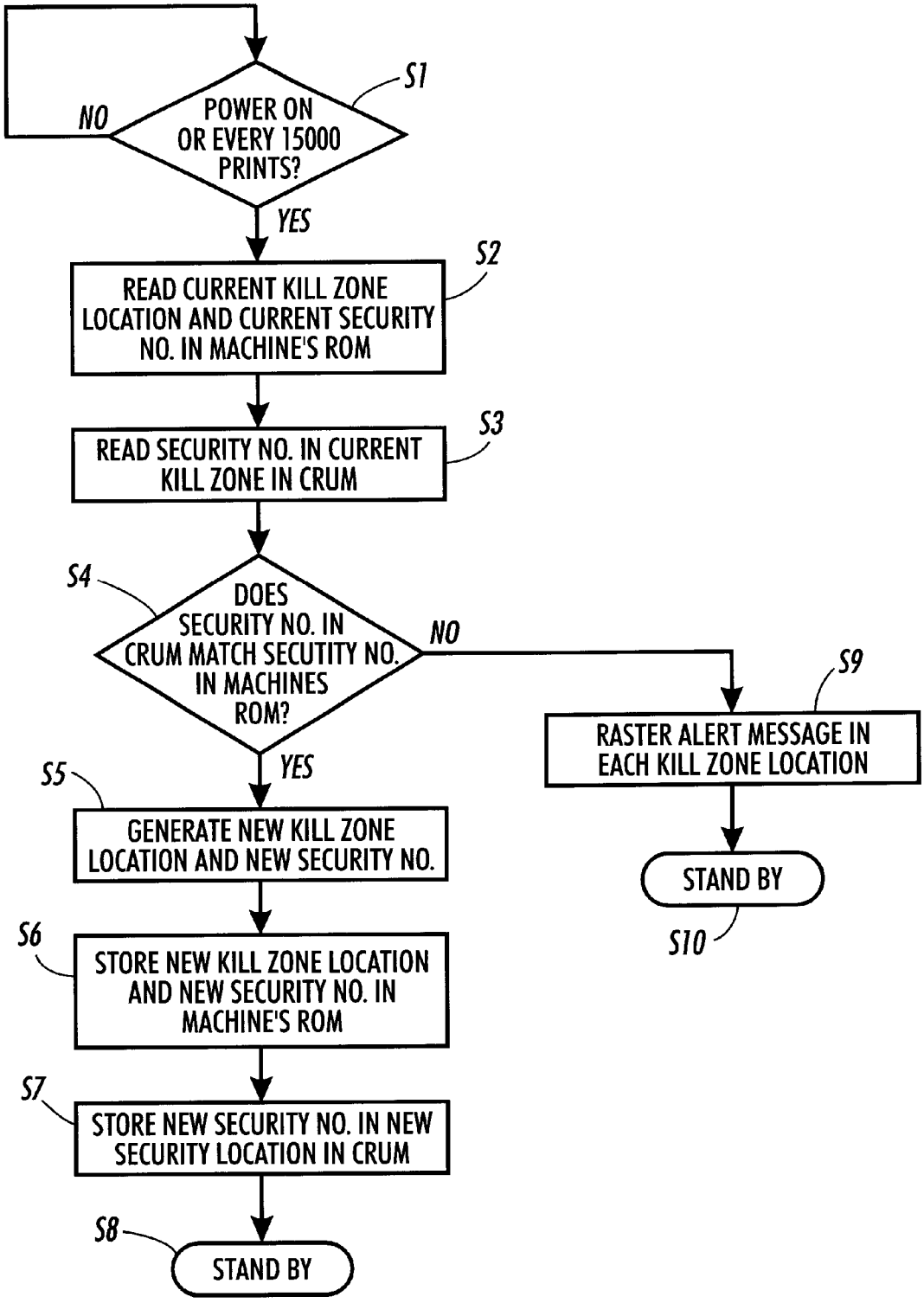
FIG. 6 is a simplified flowchart depicting the security process according to the present invention.

FIG. 6 is a flowchart illustrating, by way of example, one possible process for implementing a floating kill zone according to the present invention. After a predetermined interval, for example after every 15000 prints (step S1), the MCU 130 retrieves the current kill zone location and the current security number from the MCU's ROM (step S2). The MCU then reads the number stored in the kill zone location in the CRUM's EEPROM that corresponds with the retrieved current kill zone (step S3). The number retrieved from the current kill zone location in the CRUM is compared with the current security number retrieved from the ROM (step S4). If the two security numbers match, then the MCU randomly generates a new current kill zone location and randomly generates a new current security number and updates the CRU's memory accordingly (step S5). The new current security number is written into the machines ROM (stepS6) new current kill zone location in the CRUM (step S7). The floating kill zone is thus moved to a new kill zone location, as indicated by the dashed arrows in FIG. 5, and the security number is changed to a new random number. Finally, the machine is placed in a stand by condition in preparation for making prints (step S8).

On the other hand, if the number retrieved form the current kill zone in the CRUM does not match the current security number retrieved form the MCU's ROM, then the MCU writes an encrypted "alert" message into each of the kill zone locations Z1–Z5 (step S9). The machine may then be placed in a stand by condition in preparation for making prints (step S10). The encrypted alert message will subsequently be detected by a service technician accessing the CRUM's memory. The technician will thereby be alerted that the integrity of the security kill zone may have been breached and that the automated print count that enables the CRU to provide messages regarding the expiration of cartridges and/or licenses may have been circumvented. The technician may then take appropriate action. Appropriate action may entail checking the condition of the CRU's to determine if any one of the CRU's has reached the end of its useful life and requires replacement or servicing. Appropriate action may also entail reporting the occurrence to the licensor or vendor, thereby alerting the licensor or vendor of a possible breach of a warranty condition or possible breach of a license.

The use of a CRUM having a floating or dynamic kill zone makes it more difficult to circumvent the security features of the CRUM when attempting to reverse engineer the architecture and programming of the CRUM. Since the kill zone is continually moving, it is difficult to determine its location. If one were to identify the location of the kill zone in the CRUM on any given CRU, it would not be of any assistance in later attempting to read and reprogram a different CRU. Since the floating kill periodically randomly moves to a new location, the odds are that the kill zone in one CRUM will not be in the same location as the kill zone in a different CRUM. As a result, it becomes much more difficult for one to reset a CRUM in order to extend the life of the CRU beyond its useful, warranted or licensed life span.

It will be appreciated that a floating kill zone according to the present invention may randomly move to a new location as described above, without a new security number being generated. The security number may be a constant number that is preset during manufacture of the CRUM. In this case, the security number must be removed from the previous kill zone location.

While the present invention has been disclosed as implemented by means of replaceable photoreceptor, developer, and toner cartridges, the invention is not limited to the number and types of cartridges disclosed. It will be appreciated that the present invention is equally well suited to any application in which one or more replaceable cartridges, such as those described or other cartridges or replaceable modules, are used.

The invention has been described by way of example with reference to the structure disclosed. The invention is not confined to the details set forth, but is intended to cover such modifications or changes as may come within the scope of the following claims.

What is claimed is:

1. A security method for a replaceable component of a printing machine comprising the steps of:

a) providing said replaceable component with a memory source having a plurality of addressed floating memory locations;

b) randomly selecting one of said floating memory locations as a security location;

c) writing a security code into said security location; and d) periodically repeating steps b) and c).

2. The method of claim 1, further comprising the step of removing said security code from the previous said security location.

3. The method of claim 1, further comprising the steps of:

providing said machine with a machine memory device;

storing said security code in said machine memory device;

storing the address of said security location in said machine memory device; and periodically comparing a code in a said floating memory location at said address stored in said machine memory device with said security code in said machine memory device.

4. The method of claim 3, further comprising the step of, if said code in said floating memory location at said address stored in said machine memory device is not the same as said security code in said machine memory device, then writing an alert code into each of said addressed memory locations.

5. The method of claim 4, wherein said alert code is encrypted.

6. The method of claim 4, further comprising the step of, if said code in said floating memory location at said address stored in said machine memory device is not the same as said security code in said machine memory device, then disabling the replaceable component.

7. The method of claim 4, further comprising the step of, if said code in said floating memory location at said address stored in said machine memory device is the same as said security code in said machine memory device, then placing the machine in a stand by mode ready to make prints.

8. The method of claim 4, wherein step c) further comprises randomly generating a number as said security code.

9. The method of claim 1, wherein step c) further comprises randomly generating a number as said security code.

10. The method according to claim 1, wherein step d) comprises repeating steps b) and c) after a predetermined number of images have been produced by said component.

* * * * *